United States Patent [19]

Rennebaum

[11] Patent Number: 4,805,433

[45] Date of Patent: Feb. 21, 1989

[54] MULTI-ROLL ROLLING STAND HAVING INTERMEDIATE ROLLS WHICH CAN BE DISPLACED IN PAIRS IN OPPOSITE DIRECTIONS AND HAVE TAPERED ENDS

[75] Inventor: Heinrich Rennebaum, Menden, Fed. Rep. of Germany

[73] Assignee: Sundwiger Eisenhutte Maschinenfabrik Grah & Co., Fed. Rep. of Germany

[21] Appl. No.: 81,992

[22] Filed: Aug. 5, 1987

[30] Foreign Application Priority Data

Aug. 5, 1986 [DE] Fed. Rep. of Germany ..... 3626516
Jun. 23, 1987 [DE] Fed. Rep. of Germany ..... 3720610

[51] Int. Cl.[4] ..... B21B 29/00; B21B 31/18
[52] U.S. Cl. ..... 72/242; 72/247
[58] Field of Search ..... 72/242, 243, 247

[56] References Cited

U.S. PATENT DOCUMENTS

| | | | |
|---|---|---|---|
| 2,776,586 | 1/1957 | Sendzimir | 72/242 |
| 3,858,424 | 1/1975 | Kajiwara et al. | 72/242 |
| 4,270,377 | 6/1981 | Verbickas et al. | 72/247 X |
| 4,519,233 | 5/1985 | Feldmann et al. | 72/247 |
| 4,656,859 | 4/1987 | Ginzburg | 72/247 X |

FOREIGN PATENT DOCUMENTS

| | | | |
|---|---|---|---|
| 0049798 | 4/1984 | European Pat. Off. . | |
| 955131 | 12/1956 | Fed. Rep. of Germany . | |
| 2835514 | 1/1980 | Fed. Rep. of Germany . | |
| 0053310 | 3/1983 | Japan | 72/242 |
| 0053311 | 3/1983 | Japan | 72/247 |
| 0003902 | 1/1985 | Japan | 72/242 |

OTHER PUBLICATIONS

Bahr et al, *Herstellung von Kaltgewalztem Band;* (Production of Cold Rolling Strips) (1970), p. 307.

*Primary Examiner*—Robert L. Spruill
*Assistant Examiner*—Steven B. Katz
*Attorney, Agent, or Firm*—Kerkam, Stowell, Kondracki & Clarke

[57] ABSTRACT

In a multi-roll rolling stand having two intermediate rolls 3 to 6, which each have only one tapered roll barrel end, in each case two tapered roll barrel ends lie on each side of the rolling stand. The intermediate rolls 3, 4 and 5, 6, the two roll barrel ends of which lie on the same side of the rolling stand, are independently displaceable in an axial direction. Due to the axial offset of the tapered roll barrel ends which can be achieved in this manner, the support curve of the work rolls 1, 2 in the edge regions of the rolled strip can be finely adjusted. In addition, the support curve in the center region of the strip can also be adjusted if in each case one of the two work rolls 3, 4 associated with each work roll 1, 2 is contoured.

16 Claims, 2 Drawing Sheets

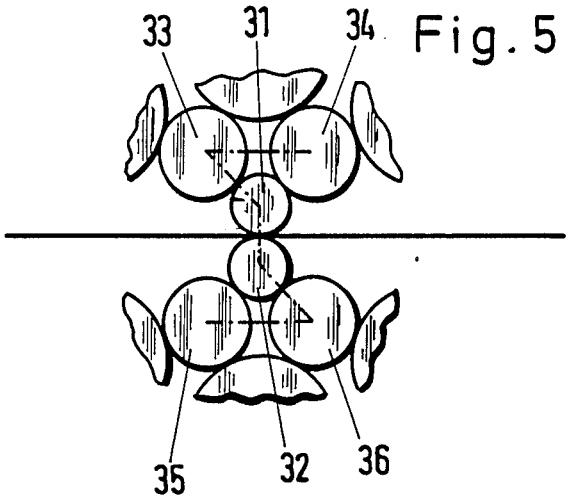
Fig. 5
Fig. 6
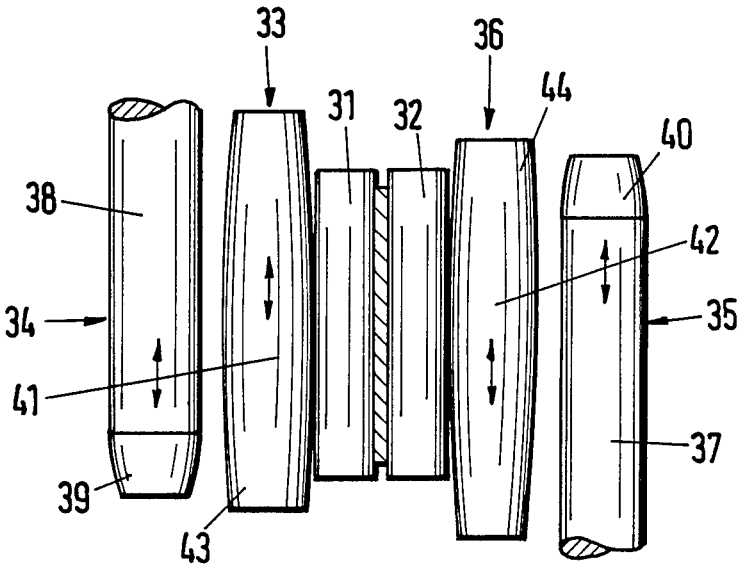

MULTI-ROLL ROLLING STAND HAVING INTERMEDIATE ROLLS WHICH CAN BE DISPLACED IN PAIRS IN OPPOSITE DIRECTIONS AND HAVE TAPERED ENDS

BACKGROUND OF THE INVENTION

1. Technical Field

The invention relates to a multi-roll rolling stand whose two work rolls are each supported directly or indirectly via a pair of axially adjustable intermediate rolls on back-up rolls or on supporting rolls arranged in series, each intermediate roll having only one tapered roll barrel end and there being in each case two tapered roll barrel ends on each side of the rolling stand.

2. Description of the Prior Art

It is known that when strips are rolled in a multi-roll rolling stand, the strip edges are subjected to higher pressure than the central regions of the strip, unless countermeasures are taken.

One known countermeasure in multi-roll rolling stands in which, for structural reasons, the work or intermediate rolls cannot simply be bent, as is known in the case of other rolling stands, consists in supporting the work rolls via intermediate rolls over only part of their length rather than over their entire length, the partial length being adjustable.

In a known rolling stand of the type mentioned at the outset (German Patent Specification No. 2,835,514) each work roll is supported on a pair of intermediate rolls. The intermediate rolls are tapered in a similar manner at in each case one end, either conically, parabolically or in another manner, the tapered roll barrel ends of the intermediate rolls associated with different work rolls lying on opposite sides of the rolling stand while the tapered roll barrel ends of the intermediate rolls associated with the same work roll lie on the same side of the rolling stand. By axial displacement of one of the pairs of intermediate rolls and of both pairs of intermediate rolls in a rolling stand of this type, the support length can be adjusted in accordance with the width of the strip to be rolled in such a manner that each edge of the rolled strip overlaps the tapered ends to a greater or lesser extent.

In addition to the adjustment of the intermediate rolls to the edges of the rolled strip, the influencing of the roll nip profile in the central region of the rolled strip is also known in multi-roll rolling stands of this kind. This is achieved by presetting the bearings for supports (saddles) between the support rolls at in each case two back-up rolls, via which the forces associated with rolling are diverted into the one- or two-part housing.

A multi-roll rolling stand of this type has proven its worth over many years in practice; however, the adjustment possibilities for influencing the roll nip profile on such multi-roll rolling stands, namely the axial displacement in pairs of the intermediate rolls having roll barrel ends tapered on one side and the presetting of the bending line at two back-up rolls, are, in many cases, not sufficient to meet the demands commonly made today with respect to the surface evenness of the strips. In particular, it is not possible with such multi-roll rolling stands to carry out an adequate adjustment of the roll nip profile in the region of the strip edges, given the forms of tapering of the roll barrel ends of the intermediate rolls, when the thickness profile of the rolled strip differs greately from strip to strip. The same applies to an abrupt change in the deformation resistance of the material being rolled.

The state of the art also includes two-high, four-high or six-high rolling stands (EP No. 0 049 798 A2), the axially displaceable intermediate or work rolls of which have curved contours running in opposite directions over the barrel length as a whole, these contours complementing one another so as to leave no gaps when the intermediate rolls are in a particular axial position. Rolling stands, the intermediate or work rolls of which have roll barrels contoured in this way are said to make a uniform and continuous alteration of the roll nip profile over the whole length of the roll nip, the influencing of the rolled strip in the edge region being achieved by the known method of roll bending which is possible here.

SUMMARY OF THE INVENTION

The object on which the invention is based is to provide a multi-roll rolling stand of the type mentioned at the outset in which the support given to the work rolls, in particular in the edge regions of the rolled strip, can be adjusted to a greater extent than before.

This object is achieved according to the invention in that the intermediate rolls associated with the same work roll and having tapered roll barrel ends can be adjusted independently of each other and in such a way that the adjacent tapered roll barrel ends are axially offset with respect to one another.

By offsetting those roll barrel ends which lie on the same side of the rolling stand to a greater or lesser extent, it is possible, according to the invention, taking into account the shape of the roll barrel ends, to influence the support curve at the edges of the rolled strip. This is because, under the influence of the rolling force, the work rolls conform to this curve. For the particular edge region of the rolled strip, an alteration of the adjustment position of one or both work rolls, the tapered roll barrel ends of which are associated with the same edge of the rolled strip, has the effect of an alteration in the roll nip profile. This also provides the possibility of fine adjustment for influencing the evenness of the strip.

Since the support curve for the work rolls includes not only the axial offset of the tapered roll barrel ends but also their contour, the roll barrel ends associated with the same strip edge can have different taper contours.

However, it is not only in the edge regions of the rolled strip that the support curve for the work rolls can be influenced by means of intermediate rolls which can be offset independently of one another in the axial direction. It can also be done in the region between the edge regions if, according to a further embodiment of the invention, one intermediate roll of each pair of intermediate rolls has a contour deviating from the cylindrical form between the roll barrel ends. Since the shape of the roll nip which establishes itself under the rolling force can be calculated by adding the local diameters of the contoured intermediate rolls contacting the work rolls at the same point, it is easy in practice, for the person skilled in the art, to select a suitable dimension for the contour for the particular purpose.

In an alternative embodiment to this embodiment, each arrestable intermediate roll is supported on the back-up rolls or the support rolls via at least one further intermediate roll having a contoured roll barrel. With this embodiment, it is possible to achieve comparable effects to those achieved with contoured roll barrels for the intermediate rolls directly supporting the work rolls. Within the scope of this embodiment, there are two preferred embodiments. One consists in the fact that the central intermediate roll, which in each case supports one pair of intermediate rolls, has the contoured roll barrel while the other consists in the fact that the outer intermediate roll, in each case supporting one of the intermediate rolls of each pair of intermediate rolls, has the contoured roll barrel.

In a preferred embodiment, the contour of each intermediate roll is arranged unsymmetrically with respect to the centre of the roll barrel. In particular, the unsymmetrically contoured roll barrels of the two intermediate rolls should run in opposite directions to one another. In an arrangement of this kind, a relative axial displacement of the two intermediate rolls has the effect of increasing or decreasing the curvature of the roll nip profile in the central region.

The unsymmetrical contouring of the intermediate rolls is suitable, in particular, for those multi-roll rolling stands in which presetting of the support line at the back-up rolls is not possible, for example when the back-up rolls are solid. However, intermediate rolls with contoured roll barrels can in addition also be used in multi-roll rolling stands which do have the conventional adjustment facility for back-up rolls. In such multi-roll rolling stands, the roll nip-influencing action of the axially displaceable intermediate rolls having the contoured roll barrels is particularly useful if a series of rolling operations is being carried out in which the rolling forces are so small that the intermediate rolls and the axes of the back-up rolls are not deformed sufficiently for the support saddles of the back-up rolls to be able to rest completely on the preadjusted bearings.

Since, when intermediate rolls which support the work rolls directly and have contoured roll barrels are used, only the work rolls have to adapt to this shape, and since therefore this adaptation occurs even when the rolling forces are small, this embodiment of the invention is suitable for the infinitely variable adjustment of the roll nip profile in the temper-rolling or rerolling of strips to give a particular strength.

When intermediate rolls having contoured roll barrels are used as intermediate rolls directly supporting the work rolls, the adjustment of these intermediate rolls also brings about a preadjustment with respect to the strip edges. Fine adjustment is then carried out by means of the other intermediate rolls, only the roll barrel ends of which are tapered.

BRIEF DESCRIPTION OF THE DRAWINGS

The invention is explained in more detail below with reference to a drawing, in which:

FIG. 5 is a side view of a cut out of the rolling stand according to FIG. 1, with intermediate rolls which differ from the intermediate rolls of FIGS. 2 to 4 and FIG. 6 is a representation of the intermediate rolls and work rolls of the stand according to FIG. 5 opened out in accordance with the chain . . . of FIG. 5.

DETAILED DESCRIPTION OF THE INVENTION

Figure 1:
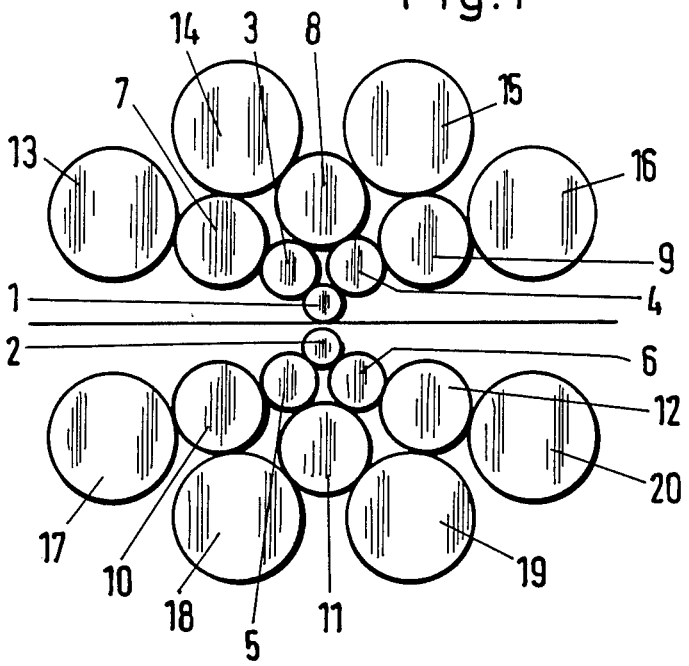
FIG. 1 is a diagrammatic representation of the rolls of a multi-roll rolling stand as seen from the side.

In the multi-roll rolling stand shown in FIG. 1, each work roll 1, 2 is supported via a pair of intermediate rolls 3 to 6 and three further intermediate rolls 7 to 12 on four back-up rolls 13 to 20. The roll barrels of each pair of intermediate rolls 3 to 6 are in each case conically or parabolically tapered at one barrel end only. However, other taper contours are also possible.

Figure 2:
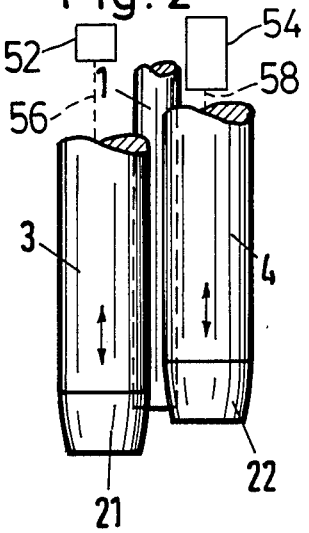
FIG. 2 to FIG. 4 show plan views of end sections of the intermediate rolls associated with the same work roll in the rolling stand according to FIG. 1, in various embodiments of the roll barrel ends.

In the exemplary embodiment of FIG. 2, the roll barrel ends 21, 22 have the same conical shape. The arrangement is such that the conical roll barrel ends 21, 22 of the intermediate rolls 3, 4 associated with the work roll 1 lie on one side of the rolling stand and thus also at one edge of the rolled strip, while the roll barrel ends, likewise of the same conical form, of the intermediate rolls 5, 6 associated with the other work roll 2 lie on the other side of the rolling stand and thus also at the other edge of the rolled strip.

Figure 3:
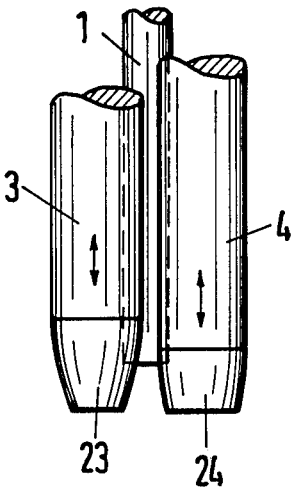

The exemplary embodiment of FIG. 3 differs from that of FIG. 2 only in that the roll barrel ends 23, 24 have different contours. In the exemplary embodiment of FIG. 4, the conical roll barrel ends 25, 26 of inner intermediate rolls 3, 4 associated with the same work roll 1 are arranged on opposite sides of the rolling stand. The same applies to the roll barrel ends of the intermediate rolls 5, 6 associated with the other work roll 2. In this exemplary embodiment, the intermediate rolls 3 to 6, the conical roll barrel ends of which lie on the same side of the rolling stand, should expediently by diagonally opposite with respect to the surface of the material being rolled.

Figure 4:
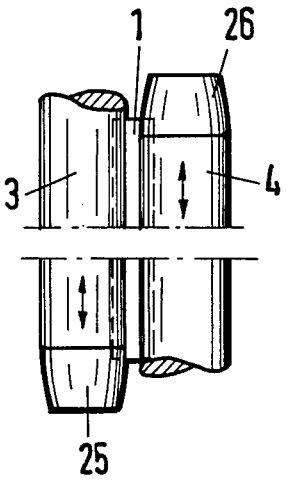

In all embodiments, the intermediate rolls 3 to 6, whose conical roll barrel ends 21 to 26 lie on the same side of the rolling stand and therefore act on the same strip edge, are independently adjustable in the axial direction so that an axial offset, such as that illustrated in FIG. 2 to 4, can be set. Actuators 52, 54 acting on the intermediate rolls along axes 56, 58, respectively, may serve as axial adjustment means.

In the exemplary embodiment of FIGS. 5 and 6, the intermediate rolls 33, 34, 35, 36 associated with each of the work rolls 31, 32, are of different designs. Whereas the intermediate rolls 34, 35, like the intermediate rolls of the exemplary embodiment of FIGS. 2 to 4, have a cylindrical roll barrel 37, 38 with a conical roll barrel end 39, 40, the roll barrels 41, 42 of the other two intermediate rolls 33, 36 are contoured over their entire length. The contour of roll barrels 41, 42 is slightly parabolic, the maximum diameter lying outside the axial centre. The said asymmetry in each of the roll barrels 41, 42 is the reverse of the other. This contour of the roll barrels 41, 42 naturally includes at least one tapered roll barrel end 43, 44.

The curvature of the rolling profile in the central region of the strip can be made more or less pronounced as a function of the relative axial displacement of the two intermediate rolls 33, 36 having the contoured roll barrels 41, 42. After setting the desired rolling profile, fine adjustment of the support curve at the strip edges can be achieved by axial displacement of the intermediate rolls 34 and 35.

As an alternative to the exemplary embodiment of FIGS. 5 and 6 having at least one intermediate roll 33, 36 directly supporting the work rolls 31, 32 and having a contoured roll barrel 41, 42, it is possible for the additional intermediate rolls 7–12 in the exemplary embodiment of FIGS. 1–4 to have contoured roll barrels corresponding to the roll barrels 41, 42 of the intermediate rolls 33, 36 of the exemplary embodiment of FIGS. 5 and 6. In preferred embodiments, either the intermediate rolls 8 and 11 or the intermediate rolls 7, 9 and 10, 12 have a contoured roll barrel. In either case, this ensures that the intermediate rolls 3, 4 and 5, 6 immediately supporting the work rolls are supported on an intermediate roll 7–12 having a contoured roll barrel.

What is claimed is:

1. Multi-roll rolling stand comprising two work rolls, each supported via a pair of intermediate rolls being axially movable and adjustable and being supported on back-up rolls, each intermediate roll having at least one reduced diameter roll barrel end and there being for each pair of intermediate rolls, at least two reduced diameter roll barrel ends adjacent each other on at least one side of the rolling stand, means for axially adjusting independently of each other the intermediate rolls (3, 4, 33, 34 and 5, 6, 35, 36 respectively) which engagingly support each said work roll (1, 31 and 2, 32 respectively), said adjacent intermediate reduced diameter roll barrel ends (21–24, 39, 40, 43, 44 respectively) being axially offset with respect to one another.

2. Multi-roll rolling stand according to claim 1, wherein each of said reduced diameter roll barrel ends (23, 24, 39, 40, 43 and 44) disposed on the same side of the rolling stand comprise conical taper contours of different shape from the other of said reduced diameter roll barrel ends.

3. Multi-roll rolling stand according to claim 1, wherein the barrel (41 or 42 respectively) of one of the intermediate rolls (33, 34 or 35, 36 respectively) which supports each said work roll (31 or 32 respectively) is cylindrical and has a conical taper contour roll barrel end (39 or 40) and the other of the intermediate rolls has a generally parabolic contoured shape, whereby the intermediate rolls (33 and 36 respectively) which are disposed diagonally to each other with respect to a rolling plane are corresponding and complementary to each other and have a commonly shaped contour such that when these rolls (33 and 36) are offset axially in opposite directions, they produce a greater or lesser curvature of the roll nip profile.

4. Multi-roll rolling stand according to claim 1 or 2, wherein each adjustable intermediate roll (3–6) is an inner intermediate roll and is supported on said back-up rolls (13–20) via at least one outer intermediate roll having a generally parabolic contoured roll barrel.

5. Multi-roll rolling stand according to claim 4, wherein said at least one outer intermediate roll comprises three rolls arranged in a partial semicircle, and a central one of said outer intermediate rolls (8 and 11 respectively) which each support a pair of inner intermediate rolls (3, 4 or 5, 6 respectively) has a generally parabolic contoured roll barrel.

6. Multi-roll rolling stand according to claim 4 wherein said outer intermediate rolls (7, 9 and 10, 12), which each support one of the inner intermediate rolls (3, 6) of each pair of inner intermediate rolls (3, 4 and 5, 6 respectively), have a generally parabolic contoured roll barrel.

7. Multi-roll rolling stand according to claim 3, wherein said contour of the generally parabolic contoured roll barrels (41 and 42) is a truncated elongated ovoid symmetrical about its axis but asymmetrical about its center in the longitudinal dimension.

8. Multi-roll rolling stand according to claim 7, wherein each of said generally parabolic contoured roll barrels (41 and 42) are disposed in opposite directions with respect ot their contour asymmetry as that of the corresponding complementary contoured roll barrels.

9. Multi-roll rolling stand according to claim 5, wherein said outer intermediate rolls (7, 9 and 10, 12), which each support one of the inner intermediate rolls (3–6) of each pair of inner intermediate rolls (3, 4 and 5, 6 respectively), have a generally parabolic contoured roll barrel.

10. Multi-roll rolling stand according to claim 4, wherein said contour of the generally parabolic contoured roll barrels (41 and 42) is a truncated, elongated ovoid symmetrical about is axis but asymmetrical about its center in the longitudinal dimension.

11. Multi-roll rolling stand according to claim 10, wherein each of said generally parabolic contoured roll barrels (41 and 42) are disposed in opposite directions with respect to their contour asymmetry as that of the corresponding opposite contoured roll barrels.

12. Multi-roll rolling stand according to claim 5, wherein said contour of the generally parabolic contoured roll barrels (41 and 42) is a truncated elongated ovoid symmetrical about its axis but asymmetrica about its center in the longitudinal dimension.

13. Multi-roll rolling stand according to claim 12, wherein each of said generally parabolic contoured roll barrels (41 and 42) are disposed in opposite directions as the corresponding complementary contoured roll barrels with respect to their contour asymmetry.

14. Multi-roll rolling stand according to claim 6, wherein said contour of the generally parabolic contoured roll barrels (41 and 42) is a truncated elongated ovoid symmetrical about is axis but asymmetrical about its center in the longitudinal dimension.

15. Multi-roll rolling stand according to claim 1, wherein at least one of each of said intermediate roll barrels (41 and 42) has an asymmetrical generally parabolic contour disposed in opposite directions with respect to their contour asymmetry as that of the corresponding contoured roll barrels having a generally parabolic contour on the opposite side of a rolling plane.

16. Multi-roll rolling stand having two work rolls separated by a rolling plane, each of said work rolls being supported via a pair of axially adjustable intermediate rolls themselves supported on back-up rolls, each intermediate roll having a cylindrical roll barrel and only one conical taper contour roll barrel end and there being in each case two intermediate rolls on one side of the rolling plane having their conical taper contour roll barrel ends on opposite sides of the rolling stand, and the intermediate rolls associated with the complementary corresponding working roll on the other side of said rolling plane having their conical taper contour roll barrel ends on opposite sides of the rolling stand, and with regard to the rolling plane, diagonally disposed intermediate roll barrel ends being on the same side of the rolling stand, said diagonally disposed intermediate rolls having adjustable positioning means which independently position said diagonally disposed roll barrel ends so that they are axially offset with respect to one another.

* * * * *

UNITED STATES PATENT AND TRADEMARK OFFICE

CERTIFICATE OF CORRECTION

PATENT NO. : 4,805,433

DATED : February 21, 1989

INVENTOR(S) : Rennebaum

It is certified that error appears in the above-identified patent and that said Letters Patent is hereby corrected as shown below:

In Claim 8, line 4, "ot" should be --to--.

In Claim 10, line 4, "is" should be --its--.

In Claim 12, line 4, "asymmetrica" should be --assymetrical--.

In Claim 14, line 4, "is" should be --its--.

Signed and Sealed this

Second Day of January, 1990

*Attest:*

JEFFREY M. SAMUELS

*Attesting Officer*

*Acting Commissioner of Patents and Trademarks*